US007553152B2

(12) United States Patent
Merry et al.

(10) Patent No.: US 7,553,152 B2
(45) Date of Patent: Jun. 30, 2009

(54) FLAME DETECTOR TRAPEZOIDAL EXCITATION GENERATOR OUTPUT CONTROL CIRCUIT AND METHOD

(75) Inventors: Mark F. Merry, Tucson, AZ (US); Jeff D. Miller, Tucson, AZ (US); Frank J. Madison, Oro Valley, AZ (US)

(73) Assignee: Honeywell International Inc., Morristown, NJ (US)

( * ) Notice: Subject to any disclaimer, the term of this patent is extended or adjusted under 35 U.S.C. 154(b) by 743 days.

(21) Appl. No.: 11/165,716

(22) Filed: Jun. 23, 2005

(65) Prior Publication Data

US 2006/0290389 A1 Dec. 28, 2006

(51) Int. Cl.
*F23N 5/00* (2006.01)

(52) U.S. Cl. ..... 431/75; 431/79; 250/214 A; 250/339.15; 315/307; 315/291; 315/224; 315/239

(58) Field of Classification Search ..... 60/39.12, 60/39.183, 39.281, 740, 776; 431/75, 79, 431/346, 350; 340/577, 578, 583; 250/339.15, 250/339.02, 214 A, 206; 315/149, 151, 209 M, 315/239, 224, 291, 307
See application file for complete search history.

(56) References Cited

U.S. PATENT DOCUMENTS

| | | | | |
|---|---|---|---|---|
| 3,402,353 | A | 9/1968 | Hubbs | |
| 3,597,638 | A | 8/1971 | Jensen | |
| 3,603,949 | A | 9/1971 | Walthard | |
| 3,660,775 | A | 5/1972 | Nechay | |
| 3,772,533 | A | 11/1973 | Bruckner et al. | |
| 3,830,967 | A | 8/1974 | Long | |
| 3,902,839 | A | 9/1975 | Matthews | |
| 4,115,998 | A | 9/1978 | Gilbert et al. | |
| 4,161,773 | A | 7/1979 | Szpakowski | |
| 4,280,058 | A | 7/1981 | Tar | |
| 4,498,031 | A * | 2/1985 | Stupp et al. | 315/307 |
| 4,622,005 | A | 11/1986 | Kuroda | |
| 5,636,978 | A | 6/1997 | Sasaki | |
| 5,929,450 | A | 7/1999 | Glasheen et al. | |
| 5,940,281 | A | 8/1999 | Wolf | |
| 5,961,314 | A | 10/1999 | Myhre et al. | |
| 6,053,987 | A | 4/2000 | Tanimura et al. | |
| 6,222,719 | B1 | 4/2001 | Kadah | |
| 6,366,174 | B1 * | 4/2002 | Berry et al. | 331/78 |

(Continued)

FOREIGN PATENT DOCUMENTS

EP 1542636 A * 3/1979

(Continued)

OTHER PUBLICATIONS

European Search Report 06111285.0-2301, Jul. 26, 2006.

*Primary Examiner*—Haissa Philogene
(74) *Attorney, Agent, or Firm*—Ingrassia Fisher & Lorenz, P.C.

(57) ABSTRACT

An electronic circuit for generating a trapezoidal excitation waveform includes a controllable frequency source and a trapezoidal waveform generator. The controllable frequency source generates a source waveform that, upon energization thereof, has an initial frequency value, and decreases in frequency to a substantially constant frequency value a time period after energization. The trapezoidal waveform generator receives the source waveform and, in response, generates a trapezoidal waveform at least when the source waveform frequency attains the substantially constant frequency value.

17 Claims, 2 Drawing Sheets

U.S. PATENT DOCUMENTS 6,396,718 B1 5/2002 Ng et al.
6,429,571 B2 8/2002 Raffalt et al.
6,509,838 B1 1/2003 Payne et al.
6,545,513 B2 4/2003 Tsuchida et al.
6,971,241 B2 * 12/2005 Critchley et al. ..... 60/776
7,024,862 B2 * 4/2006 Miyake et al. ..... 60/773

FOREIGN PATENT DOCUMENTS

EP 0448310 A1 9/1991

* cited by examiner

FLAME DETECTOR TRAPEZOIDAL EXCITATION GENERATOR OUTPUT CONTROL CIRCUIT AND METHOD

STATEMENT REGARDING FEDERALLY SPONSORED RESEARCH OR DEVELOPMENT

This invention was made with Government support under Contract Number 33657-99-D-2050. The Government has certain rights in this invention.

TECHNICAL FIELD

The present invention relates to flame detector excitation circuits and, more particularly, to an excitation circuit that generates a trapezoidal excitation waveform from a source waveform that varies in frequency during initial energization of the excitation circuit.

BACKGROUND

Flame detectors are used in a myriad of systems and devices. For example, many gas turbines, including both aircraft turbine engines and industrial gas turbines, include a flame detector to detect flame ignition within the combustor, and to monitor the presence and stability of the flame once it has ignited. During engine startup the flame detector provides a signal to, for example, the engine controller indicating that the fuel being supplied to the combustor has ignited. During engine operation, the flame detector monitors the continued presence and stability of the flame to detect and/or prevent adverse engine and combustor system operations, such as a flashback condition, a flameout, or various other combustion anomalies.

A relatively wide variety of flame detectors have been, and continue to be, developed that are implemented using myriad technologies. For example, phototubes, thermocouples, ionization sensors, photodiodes, and various semiconductor devices, just to name a few technologies, have been used to implement flame detectors. No matter the specific implementation, most flame sensors are supplied with a source of electrical excitation power during operation. In some instances, the power is supplied via a transformer that couples an alternating current (AC) excitation signal to the flame sensor. In at least one particular type of flame detector, the AC excitation signal is supplied, via the transformer, as a trapezoidal waveform.

Although the flame detector that is supplied with a trapezoidal waveform AC excitation signal operates safely and is generally reliable, it does suffer certain drawbacks. Specifically, the transformer that is used to couple the trapezoidal waveform AC excitation signal to the detector may have some stored residual magnetism. Thus, when the flame detector is energized, and the trapezoidal waveform AC excitation signal is first supplied to the transformer primary winding, the flux generated by the excitation signal can combine with the residual magnetism and cause the transformer to magnetically saturate. This, in turn, can cause excess current to be drawn from the trapezoidal waveform AC excitation signal source.

Hence, there is a need for a circuit and method of reducing the amount of current that is drawn from a trapezoidal waveform AC excitation signal source when a flame detector, or other device, is being energized. The present invention addresses at least this need.

BRIEF SUMMARY

The present invention provides a circuit and method that reduces the amount of current that is drawn from a trapezoidal waveform AC excitation signal source when a flame detector, or other device, is energized.

In one embodiment, and by way of example only, an electronic circuit for generating a trapezoidal excitation waveform includes a controllable frequency source and a trapezoidal waveform generator. The controllable frequency source is configured to generate a source waveform having a frequency that, upon energization of the controllable frequency source, decreases from an initial frequency value to a substantially constant frequency value a time period after energization of the controllable frequency source. The trapezoidal waveform generator is coupled to receive the source waveform and is operable, in response thereto, to generate a trapezoidal waveform at least when the source waveform frequency attains the substantially constant frequency value.

In another exemplary embodiment, a flame detector includes a sensor and an excitation circuit. The sensor is configured to detect the presence of a flame and supply a signal representative thereof. The excitation circuit is coupled to the sensor and is operable to supply a sensor excitation signal thereto. The excitation circuit includes a controllable frequency source and a trapezoidal waveform generator. The controllable frequency source is configured to generate a source waveform having a frequency that, upon energization of the controllable frequency source, decreases from an initial frequency value to a substantially constant frequency value a time period after energization of the controllable frequency source. The trapezoidal waveform generator is coupled to receive the source waveform and is operable, in response thereto, to generate a trapezoidal waveform at least when the source waveform frequency attains the substantially constant frequency value.

In yet another exemplary embodiment, a method of generating a trapezoidal waveform includes generating a square wave having a frequency that decreases from an initial frequency value to a substantially constant frequency value over a time period. The square wave is integrated to thereby generate a triangular wave having a peak voltage magnitude that increases from an initial voltage value to a substantially constant voltage value over the time period. The peak voltage magnitude of the triangular wave is limited to a predetermined value, such that the trapezoidal waveform is generated when the triangular wave peak voltage magnitude exceeds the predetermined value.

Other independent features and advantages of the preferred circuit and method will become apparent from the following detailed description, taken in conjunction with the accompanying drawings which illustrate, by way of example, the principles of the invention.

DETAILED DESCRIPTION OF A PREFERRED EMBODIMENT

The following detailed description is merely exemplary in nature and is not intended to limit the invention or the application and uses of the invention. Furthermore, there is no intention to be bound by any theory presented in the preceding background of the invention or the following detailed description of the invention. In this regard, although the circuit and method are described herein as being implemented with a flame detector, and more specifically in a gas turbine engine, it will be appreciated that the circuit and method could be used to energize any one of numerous other circuits and devices, which can be used in any one of numerous other applications.

Figure 1:
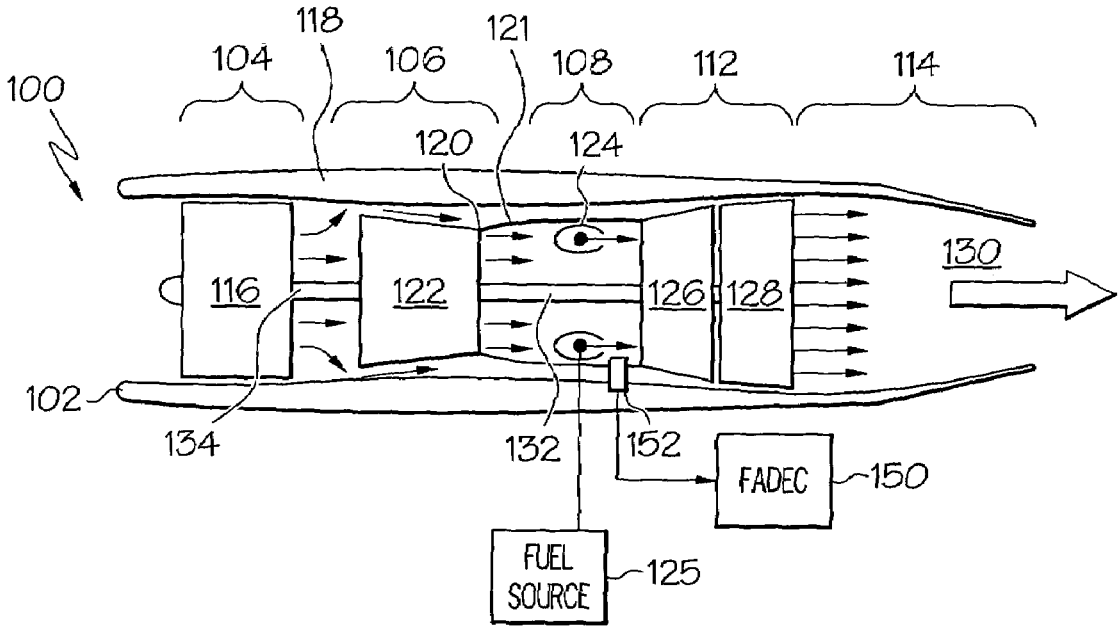
FIG. 1 is a function block diagram of an exemplary gas turbine engine that employs an embodiment of the flame detector and circuit of the present invention.

Turning now to FIG. 1, an exemplary embodiment of an exemplary gas turbine engine system 100 is shown in simplified schematic form. In the depicted embodiment, system 100 is implemented using a multi-spool turbofan gas turbine jet engine 102 that includes an intake section 104, a compressor section 106, a combustion section 108, a turbine section 112, and an exhaust section 114. The intake section 104 includes a fan 116, which is mounted in a fan case 118. The fan 116 draws air into the intake section 104 and accelerates it. A fraction of the accelerated air exhausted from the fan 116 is directed through a bypass section 120 disposed between the fan case 118 and an engine cowl 121, and provides a forward thrust. The remaining fraction of air exhausted from the fan 116 is directed into the compressor section 106.

The compressor section 106 may include one or more compressors 122, which raise the pressure of the air directed into it from the fan 116, and directs the compressed air into the combustion section 108. In the combustion section 108, which includes a combustor assembly 124, the compressed air is mixed with fuel supplied from a fuel source 125. The fuel/air mixture is ignited, and the high energy combusted air is then directed into the turbine section 112.

The turbine section 112 includes one or more turbines. In the depicted embodiment, the turbine section 112 includes two turbines, a high pressure turbine 126, and a low pressure turbine 128. No matter the particular number of turbines, the combusted air from the combustion section 108 expands through each turbine, causing it to rotate. The air is then exhausted through a propulsion nozzle 130 disposed in the exhaust section 114, providing additional forward thrust. As the turbines 126 and 128 rotate, each drives equipment in the engine 102 via concentrically disposed shafts or spools. Specifically, the high pressure turbine 126 drives the compressor 122 via a high pressure spool 132, and the low pressure turbine 128 drives the fan 116 via a low pressure spool 134.

As FIG. 1 additionally shows, the engine 102 is controlled, at least partially, by an engine controller such as, for example, a FADEC (Full Authority Digital Engine Controller) 150. The FADEC 150, as is generally known, receives various commands and sensor signals and, in response to these commands and sensor signals, appropriately controls engine operation. The number and type of commands and sensor signals supplied to the FADEC 150 may vary. For clarity and ease of depiction, only one signal source is shown. The one signal source is a flame detector 152, which is used to detect the presence and stability of the flame, once it is ignited, in the combustor assembly 124, and to supply a signal representative thereof to the FADEC.

Figure 2:
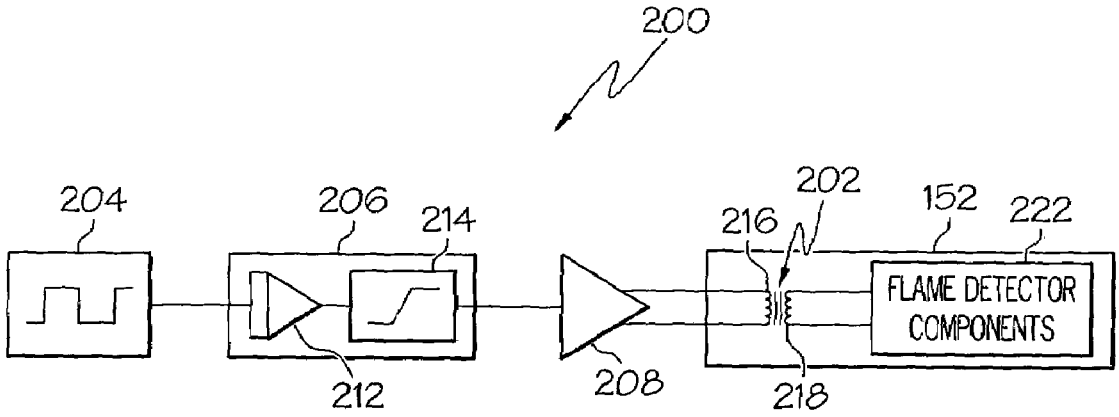
FIG. 2 is a functional block diagram of an electronic circuit for generating a trapezoidal excitation waveform according to an exemplary embodiment of the present invention, coupled to a flame detector.

The flame detector 152 may be implemented as any one of numerous known flame detectors now known or developed in the future. However, in the depicted embodiment, the flame detector 152 is supplied with a trapezoidal waveform AC excitation signal. A functional block diagram of an electronic circuit 200 for generating the trapezoidal excitation waveform is shown in FIG. 2, and will now be described in more detail.

The circuit 200, which is shown coupled to the flame detector 152 via a coupling transformer 202, includes a controllable frequency source 204, a trapezoidal waveform generator 206, and an amplifier circuit 208. The controllable frequency source 204 is configured to generate a source waveform, which is supplied to the trapezoidal waveform generator 206. The controllable frequency source 204 may be implemented using any one of numerous circuits, now known or developed in the future, that function to generate a desired source waveform. Non-limiting examples include a processor, a voltage controlled oscillator (VCO), and a programmable logic device (PLD), just to name a few.

No matter how the controllable frequency source 204 is physically implemented, it is preferably configured to generate a 50% duty-cycle square wave as the source waveform. It will be appreciated that this is merely exemplary of a particular preferred embodiment, and that the source waveform that the controllable frequency source 204 generates may have any one of numerous other shapes and/or duty-cycles. The particular wave shape, amplitude, and/or duty-cycle may vary depending, for example, upon the particular configuration of the trapezoidal waveform generator 206.

The controllable frequency source 204 is further configured such that the frequency of the generated source waveform varies from an initial frequency value, upon initially energizing the controllable frequency source 204, to a constant, or substantially constant, frequency value a time period after the initial energization. In particular, the controllable frequency source 204 is configured such that, when it is initially energized, the source waveform is generated at the initial frequency value, and then decreases in a substantially linear manner to the constant frequency value over the time period. Thereafter, for the remainder of time that the controllable frequency source 204 is energized, the source waveform frequency remains at the constant frequency value. It will be appreciated that the initial frequency value, the constant frequency value, and the time period over which initial frequency value decreases, may vary. However, in a particular preferred implementation, the initial frequency value is about 30 kHz, the constant frequency value is about 3 kHz, and the time period is about 2 seconds.

The trapezoidal waveform generator 206 is coupled to receive the source waveform from the controllable frequency source 204. The trapezoidal waveform generator 206 is operable, in response to the source waveform, to generate an excitation signal. The shape, amplitude, and frequency of the excitation signal generated by trapezoidal waveform generator 206 vary, in response to the frequency variation of the source waveform supplied from the controllable frequency source 204. It will nonetheless be appreciated that the excitation signal has a trapezoidal wave shape at least when the source waveform frequency attains the constant frequency value.

The trapezoidal waveform generator 206 may be implemented in any one of numerous configurations, using any one of numerous circuit types and configurations. In a particular preferred embodiment, however, the trapezoidal waveform generator 206 is implemented using an integrator circuit 212 and a clipper circuit 214. The integrator circuit 212, which may be implemented using any one of numerous known circuit configurations, receives the source waveform from the controllable frequency source 204 and, in response, integrates the source waveform and supplies an integrated waveform having a wave shape that is the mathematical integral of the source waveform over time. Thus, in the preferred embodiment, in which the source waveform is a 50% duty-cycle square wave, the wave shape of the integrated waveform is triangular, and has positive and negative peak voltage values that are equal in magnitude and that vary with the frequency of the source waveform.

More specifically, when the circuit 200 is first energized, and the source waveform supplied from the controllable frequency source 204 is at the initial frequency value, the integrator circuit 212 supplies the triangular waveform at the initial frequency value, and with equal positive and negative peak voltage values of an initial magnitude. As the source waveform frequency decreases over the above-mentioned time period, the triangular waveform frequency concomitantly decreases, and-the positive and negative peak voltage values concomitantly increase in magnitude, until the source waveform attains the constant frequency value.

The integrated waveform that the integrator circuit 212 generates is supplied to the clipper circuit 214. The clipper circuit 214, which may be implemented using any one of numerous known circuit configurations, receives the integrated waveform and, in response, limits the peak positive and negative voltage amplitude values to predetermined positive and negative clipping values, respectively. The specific magnitude of the predetermined positive and negative values to which the integrated waveform is limited may vary, but are preferably equal in magnitude and are chosen such that the excitation signal has the desired trapezoidal wave shape at least when the source waveform frequency, and thus the integrated waveform, attains the constant frequency value. In a particular preferred embodiment the predetermined positive and negative clipping values are +4.5 volts and −4.5 volts, respectively.

The excitation signal generated by the trapezoidal waveform generator 206 is supplied to the amplifier circuit 208. The amplifier circuit 208, which may also be implemented using any one of numerous known circuit configurations, receives the excitation signal and, in response, amplifies the excitation signal. As FIG. 2 also shows, the amplifier circuit 208 is coupled to the primary winding 216 of the coupling transformer 202, and thus supplies the amplified excitation signal to the primary winding 216. The transformer secondary winding 218 is in turn coupled to, and supplies the excitation signal to, the remaining flame detector components 222. The gain of the amplifier circuit 208 may vary, but is preferably selected to provide sufficient drive capability for the flame detector 152. The amplifier circuit 208, as is generally known, also provides appropriate impedance matching between the trapezoidal waveform generator 206 and the coupling transformer 202.

Figure 3:
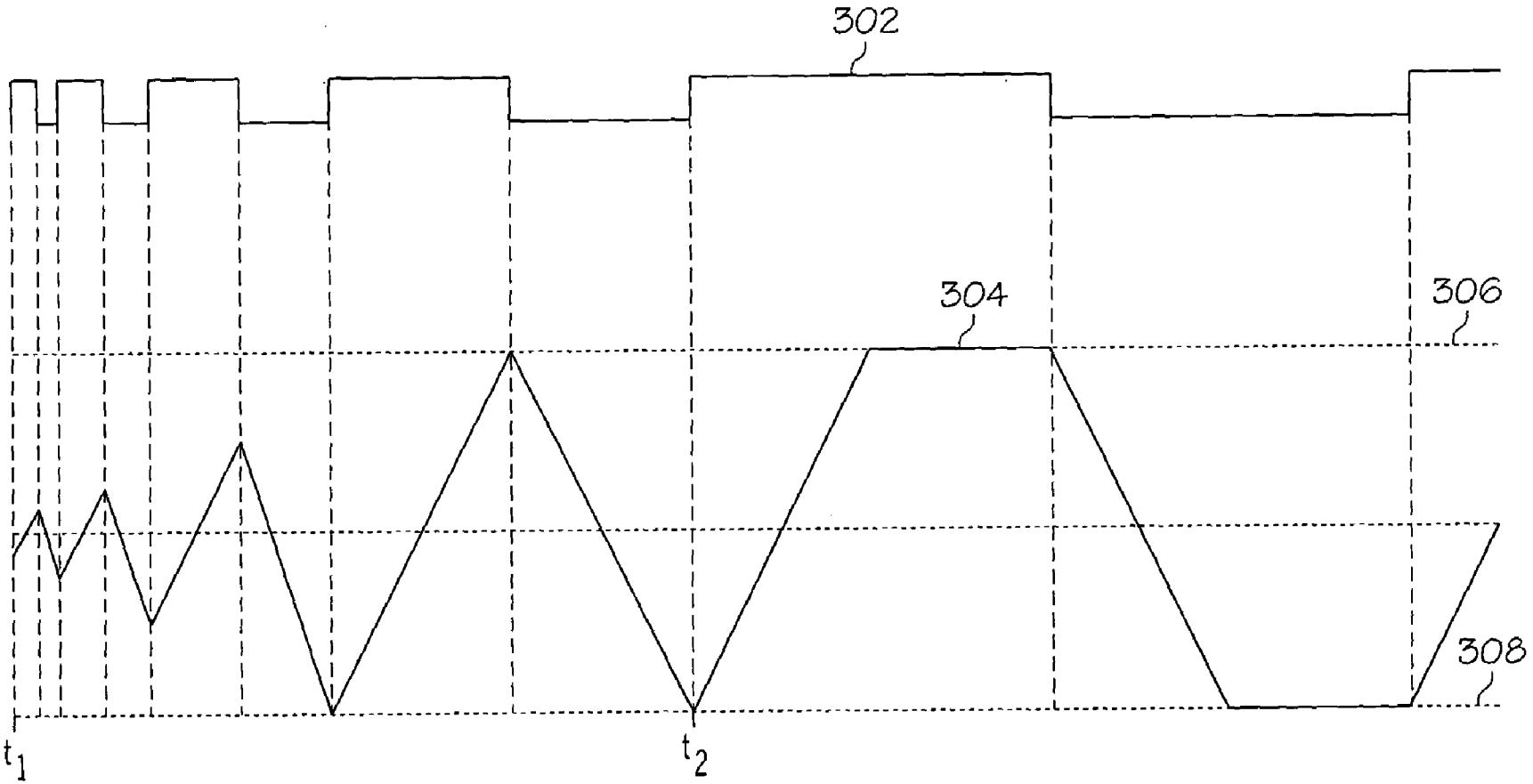
FIG. 3 is shows exemplary waveforms generated by the circuit of FIG. 2 upon, and following, energization thereof.

With reference now to FIG. 3, two exemplary waveforms generated by the circuit 200 from initial energization to steady-state operation are shown. One waveform is the source waveform 302 supplied from the controllable frequency source 204, and the other waveform is the trapezoidal waveform generator output waveform 304. As FIG. 3 shows, upon initial energization ($t_1$) the controllable frequency source 204 initially generates the source waveform 302 at the initial frequency and, over the time period ($t_1$-$t_2$), decreases the source waveform frequency to the constant frequency value. Thereafter (>$t_2$), the controllable frequency source 204 generates the source waveform 302 at the constant frequency value.

As FIG. 3 also shows, upon initial energization ($t_1$) the trapezoidal waveform generator 206 supplies the output waveform 304 at the initial frequency and initial peak positive and negative voltage magnitudes. Over the time period ($t_1$-$t_2$), as the source waveform frequency decreases, the frequency of the trapezoidal waveform generator output waveform 304 concomitantly decreases while the peak positive and negative voltage magnitudes increase. As FIG. 3 also shows, during the time period ($t_1$-$t_2$) the positive and negative peak voltage values are below the positive and negative clipping values 306 and 308, respectively. Thus, the trapezoidal waveform generator output waveform 304 has a triangular wave shape. However, by the time the source waveform 302 is being generated at the constant frequency value ($t_2$), the positive and negative peak voltage values exceed the positive and negative clipping values 306 and 308, respectively. At this point in time and thereafter (>$t_2$), the trapezoidal waveform generator output waveform 304 has a-trapezoidal wave shape.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An electronic circuit for generating a trapezoidal excitation waveform, comprising:

a controllable frequency source configured to generate a square wave having a frequency that, upon energization of the controllable frequency source, decreases from an initial frequency value to a substantially constant frequency value a time period after energization of the controllable frequency source; and a trapezoidal waveform generator coupled to receive the square wave and operable, in response thereto, to generate a trapezoidal waveform at least when the square wave frequency attains the substantially constant frequency value, the trapezoidal waveform generator comprising:

an integrator circuit coupled to receive the square wave and operable, in response thereto, to supply an integrated waveform, the integrated waveform having peak positive and negative voltage amplitude values, and a wave shape that is a mathematical integral of the source waveform over time; and a clipper circuit coupled to receive the integrated waveform and operable, in response thereto, to limit the peak positive and negative voltage amplitude values to predetermined positive and negative values, respectively.

2. The circuit of claim 1, further comprising:

an amplifier circuit coupled to receive the trapezoidal waveform and operable, upon receipt thereof, to supply an amplified trapezoidal waveform.

3. The circuit of claim 2, further comprising:

a transformer having a primary winding and one or more secondary windings, the transformer primary winding coupled to receive the amplified trapezoidal waveform.

4. The circuit of claim 1, wherein the source waveform, at least upon attaining the constant frequency value, has a 50% duty cycle.

5. The circuit of claim 1, wherein the trapezoidal waveform generator is further operable, in response to the source waveform, to generate a triangular waveform at least when the source waveform frequency is the initial frequency value.

6. The circuit of claim 1, wherein the trapezoidal waveform has a substantially constant frequency value at least when the source waveform frequency is at the substantially constant frequency value.

7. The circuit of claim 1, wherein the controllable frequency source is selected from the group consisting of a processor, a voltage controlled oscillator, and a programmable logic device.

8. The circuit of claim 1, wherein the positive and negative voltage values are equivalent in magnitude.

9. A gas turbine engine, comprising:

a compressor having an inlet and a compressed air outlet;

a turbine having at least an inlet;

a combustor having at least an air inlet, a fuel inlet, and a combustion gas outlet, the air inlet in fluid communication with the compressed air outlet, the fuel inlet adapted to receive a flow of fuel from a fuel source, and the combustion gas outlet in fluid communication with the turbine inlet; and a flame detector coupled to the combustor, the flame detector configured to detect the presence of a flame in the combustor and supply a signal representative of an intensity of the flame;

an excitation circuit coupled to the flame detector and operable to supply an excitation signal thereto, the excitation circuit including:

a controllable frequency source configured to generate a square wave having a frequency that, upon energization of the controllable frequency source, decreases from an initial frequency value to a substantially constant frequency value a time period after energization of the controllable frequency source; and a trapezoidal waveform generator coupled to receive the square wave and operable, in response thereto, to generate a trapezoidal waveform at least when the square wave frequency attains the substantially constant frequency value, the trapezoidal waveform generator comprising:

an integrator circuit coupled to receive the square wave and operable, in response thereto, to supply an integrated waveform, the integrated waveform having peak positive and negative voltage amplitude values, and a wave shape that is a mathematical integral of the source waveform over time; and a clipper circuit coupled to receive the integrated waveform and operable, in response thereto, to limit the peak positive and negative voltage amplitude values to predetermined positive and negative values, respectively.

10. A method of generating a trapezoidal waveform, comprising:

generating a square wave having a frequency that decreases from an initial frequency value to a substantially constant frequency value over a time period;

integrating the square wave to thereby generate a triangular wave having a peak voltage magnitude that increases from an initial voltage value to a substantially constant voltage value over the time period; and limiting the peak voltage magnitude of the triangular wave to a predetermined value, wherein the trapezoidal waveform is generated when the triangular wave peak voltage magnitude exceeds the predetermined value.

11. A flame detector, comprising:

a sensor configured to detect the presence of a flame and supply a signal representative of an intensity of the flame;

an excitation circuit coupled to the sensor and operable to supply a sensor excitation signal thereto, the excitation circuit including:

a controllable frequency source configured to generate a square wave having a frequency that, upon energization of the controllable frequency source, decreases from an initial frequency value to a substantially constant frequency value a time period after energization of the controllable frequency source; and a trapezoidal waveform generator coupled to receive the square wave and operable, in response thereto, to generate a trapezoidal waveform at least when the square wave frequency attains the substantially constant frequency value, the trapezoidal waveform generator comprising:

an integrator circuit coupled to receive the square wave and operable, in response thereto, to supply an integrated waveform, the integrated waveform having peak positive and negative voltage amplitude values, and a wave shape that is a mathematical integral of the source waveform over time; and a clipper circuit coupled to receive the integrated waveform and operable, in response thereto, to limit the peak positive and negative voltage amplitude values to predetermined positive and negative values, respectively.

12. The detector of claim 11, wherein the excitation circuit further comprises:

an output amplifier coupled to receive the trapezoidal waveform and operable, upon receipt thereof, to supply an amplified trapezoidal waveform.

13. The detector of claim 12, wherein the excitation circuit further comprises:

a transformer having a primary winding and one or more secondary windings, the transformer primary winding coupled to receive the amplified trapezoidal waveform.

14. The detector of claim 11, wherein the source waveform, at least upon attaining the constant frequency value, has a 50% duty cycle.

15. The detector of claim 11, wherein the trapezoidal waveform generator is further operable, in response to the source waveform, to generate a triangular waveform at least when the source waveform frequency is the initial frequency value.

16. The detector of claim 11, wherein the positive and negative voltage values are equivalent in magnitude.

17. The detector of claim 11, wherein the trapezoidal waveform has a substantially constant frequency value at least when the source waveform frequency is at the substantially constant frequency value.

* * * * *

UNITED STATES PATENT AND TRADEMARK OFFICE

CERTIFICATE OF CORRECTION

PATENT NO. : 7,553,152 B2
APPLICATION NO. : 11/165716
DATED : June 30, 2009
INVENTOR(S) : Merry et al.

It is certified that error appears in the above-identified patent and that said Letters Patent is hereby corrected as shown below:

Column 1, line 10

"Contract Number 33657-99-D-2050" should be changed to --Contract Number F33657-99-D-2050 awarded by the U.S. Air Force--.

Signed and Sealed this

Twenty-seventh Day of October, 2009

David J. Kappos

David J. Kappos
*Director of the United States Patent and Trademark Office*